United States Patent [19]

Orndorff et al.

[11] Patent Number: 4,699,251

[45] Date of Patent: Oct. 13, 1987

[54] ELEVATOR CAB

[75] Inventors: Karl B. Orndorff, Bonneauville Boro; Paul L. Baldwin, Franklin Township, Adams County, both of Pa.; Larry M. Markle, Taneytown, Md.

[73] Assignee: Westinghouse Electric Corp., Pittsburgh, Pa.

[21] Appl. No.: 863,487

[22] Filed: May 15, 1986

[51] Int. Cl.[4] ..... B66B 11/02

[52] U.S. Cl. ..... 187/1 R; 52/588

[58] Field of Search ..... 187/1 R, 20, 27; 52/588

[56] References Cited

U.S. PATENT DOCUMENTS

| | | | |
|---|---|---|---|
| 2,019,379 | 10/1935 | Anderson | 52/588 X |
| 3,481,094 | 12/1969 | Taylor | 52/588 X |
| 3,813,839 | 6/1974 | Simpson, Jr. et al. | 52/588 |
| 4,126,210 | 11/1978 | Martin | 187/1 R |
| 4,164,011 | 8/1979 | Sherwood | 362/148 |
| 4,223,503 | 9/1980 | Hague | 52/588 X |
| 4,283,897 | 8/1981 | Thompson | 52/588 X |
| 4,357,993 | 11/1982 | Halpern et al. | 403/345 X |
| 4,425,603 | 1/1984 | Courson | 362/222 |
| 4,529,062 | 7/1985 | Lamprey | 187/1 R |
| 4,557,086 | 12/1985 | Liefer et al. | 52/588 X |

*Primary Examiner*—Joseph J. Rolla
*Assistant Examiner*—Nils Pedersen
*Attorney, Agent, or Firm*—D. R. Lackey

[57] ABSTRACT

An elevator cab, and method of assembling same, including upstanding wall members on a platform, with the upstanding wall members having upper edges which support a canopy. The canopy is constructed of at least two metallic panel members having adjacent edges which are bent into complementary bend configurations which form an interlocking joint when one bend configuration is pivoted about the other bend configuration.

8 Claims, 3 Drawing Figures

ELEVATOR CAB

BACKGROUND OF THE INVENTION

1. Field of the Invention

The invention relates in general to elevator cabs, and more specifically to the construction of the elevator cab canopy.

2. Description of the Prior Art

An elevator car includes a sling, platform and cab. The sling and platform are assembled in the hoistway of a building, and the elevator cab is assembled on the platform. The elevator cab is constructed by assembling upstanding wall portions on the platform. It is conventional to suspend the elevator cab ceiling, called a canopy, in the hoistway. When the upstanding wall portions have been assembled on the platform and secured, the canopy is lowered and secured to the upper edges defined by the upstanding wall portions.

It would be desirable to improve the construction of the elevator cab canopy, as well as the method of assembling the canopy on the upstanding wall portions.

SUMMARY OF THE INVENTION

Briefly, the present invention is a new and improved elevator cab, and method of constructing same, with the cab canopy including two or more metallic panel members. The metallic panel members of the canopy are assembled on upper edges of upstanding wall portions of the cab via interlocking joints which require no seam hardware to create a tight, secure, noise-free interconnection between adjacent panel members. One of the panel members, preferably the panel member of the canopy which will be located directly below the upper crossbeam of the sling, is placed into position and secured to upper edges of the upstanding wall portions. This first positioned panel member has one or both of its lateral edges bent into predetermined bend configurations, depending upon whether one or two additional panel members will be subsequently joined thereto. Each panel member to be joined to the first positioned panel member has a lateral edge bent into a configuration which is complementary to a bend configuration on the first positioned panel member, with the complementary configurations being such that the additional panel members may simply be hooked over the first positioned panel member and pivoted into the desired assembled relationship. The subsequently placed panel members are then secured to the upper edges defined by the upstanding panel members.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
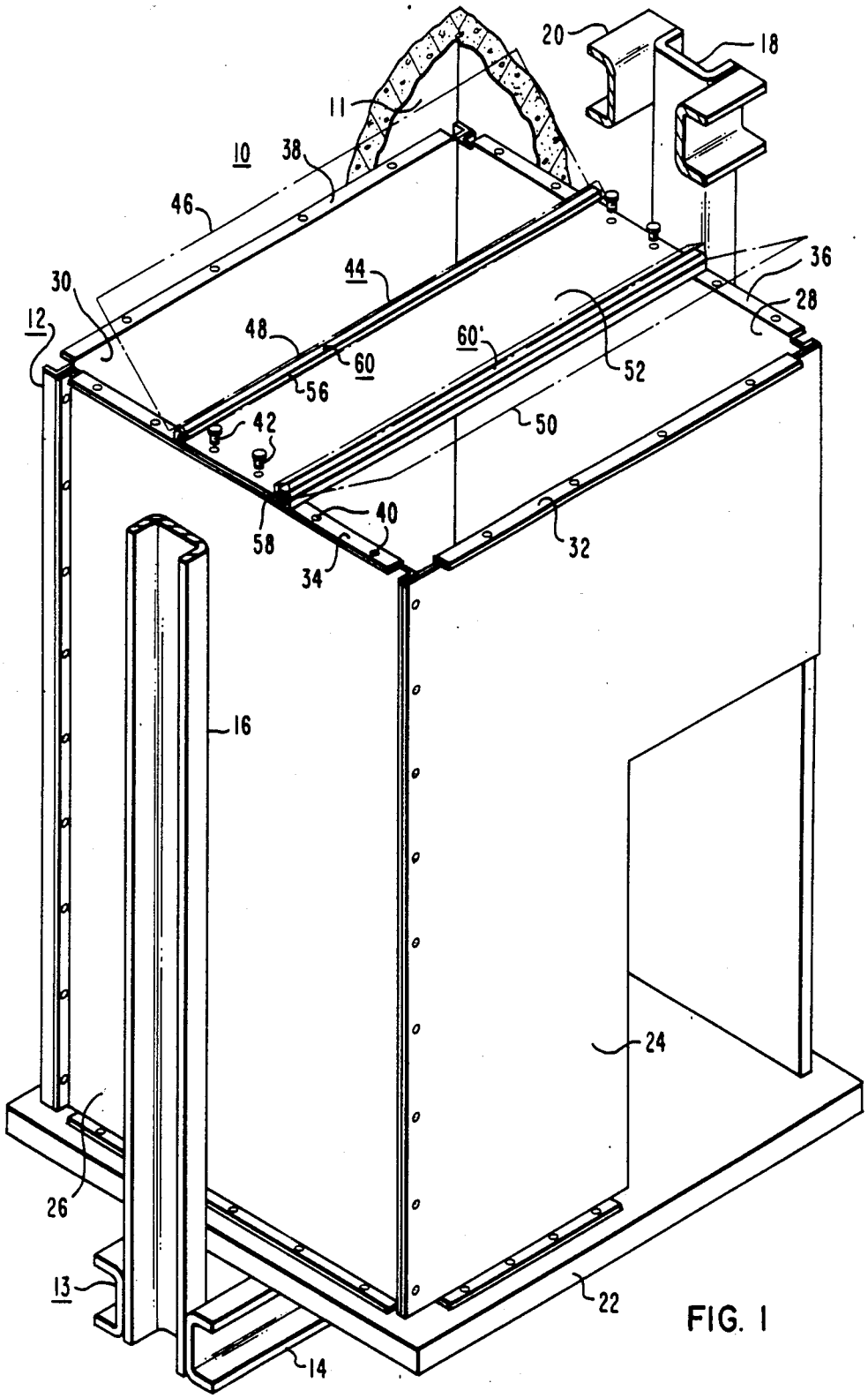
FIG. 1 is a perspective view of an elevator cab constructed according to the teachings of the invention.

Referring now to the drawings, and to FIG. 1 in particular, there is shown an elevator car 10 having a cab 12 constructed according to the teachings of the invention. Elevator car 10 includes a sling 13 which includes a lower cross beam 14, first and second upstanding stiles 16 and 18, respectively, and an upper cross head or top beam 20. A platform 22 is supported by the sling 13.

Elevator car 10 is constructed in the hoistway 11 of the building it is to serve, with the sling 13 and platform 22 being assembled for guided vertical movement via guide rollers (not shown) carried by the sling 13 which co-act with guide rails (not shown) in the hoistway 11. Sling 13 may be supported by wire ropes, in a traction elevator system, or it may be supported by a bolster plate and hydraulic cylinder in a hydraulic elevator system.

Cab 12 is then assembled on the platform 22. For example, cab 12 may include a plurality of upstanding wall portions 24, 26, 28 and 30, with wall 24 being the front wall, walls 26 and 28 being side walls, and wall 30 being a rear wall. The upstanding wall portions 24, 26, 28 and 30 are fixed to the platform 22, and they each have an upper edge adapted to receive the cab ceiling or canopy. For example, the upstanding sidewall portions may be flanged at their upper edges, with wall portions 24, 26, 28 and 30 having flanges 32, 34, 36 and 38, respectively. The flanges 32,34,36 and 38 may have suitable openings, such as openings 40 in flange 34, for receiving fastener hardware, such as screws 42.

Instead of forming a canopy in one piece, suspending it in the hoistway 11, and lowering it into position on the upstanding wall portions, the canopy of the present invention, referenced 44, is constructed piece-by-piece, in place, directly on the flanged upper edges of the upstanding wall portions. Canopy 44 includes at least two sections, and in a preferred embodiment, at least three sections. The following description is with reference to the preferred three section embodiment.

Canopy 44 includes first, second, and third sections or panel members 46,48, and 50, respectively. Each panel member 46, 48, and 50 is formed from a metallic sheet member, such as 0.060 inch thick galvanized steel. The panel members 46, 48 and 50 are oriented to extend from one side wall 26 to the other side wall 28, in the same direction as the cross-head beam 20. Thus, in the preferred three-panel embodiment of the invention, one of the panel members of canopy 44 i.e., panel member 48, will lie directly below the cross-head beam 20, across the full width of the cab 12.

Figure 2:
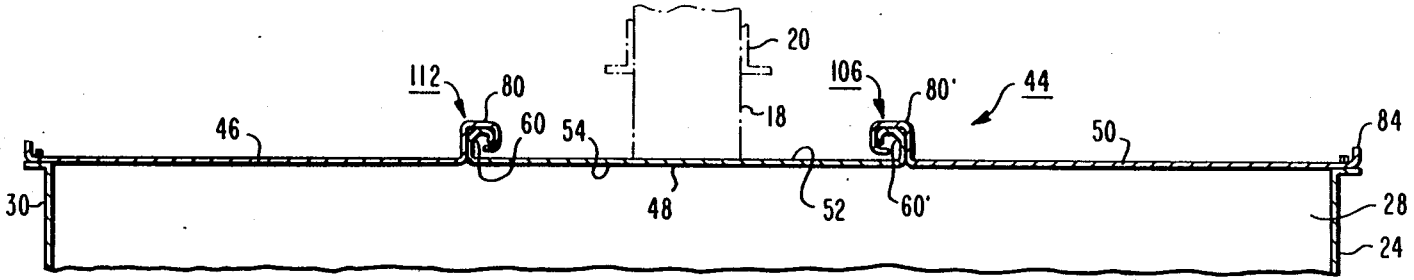
FIG. 2 is a cross sectional view of the canopy of the cab shown in FIG. 1, after two additional canopy panel members have been interlocked to the panel member shown in FIG. 1.

Panel member 48, as best shown in the cross sectional view of canopy 44 in FIG. 2, has upper and lower flat, major surfaces 52 and 54, respectively, and first and second lateral edges 56 and 58. The lateral edges are those edges which extend in the same direction as the cross-head beam 20. Lateral edges 56 and 58 are bent to provide predetermined bend configurations 60 and 60', respectively. Bend configurations 60 and 60' are mirror images of one another, and thus bend configurations 60 and 60' will be collectively referred to as the first bend configuration 60.

Figure 3:
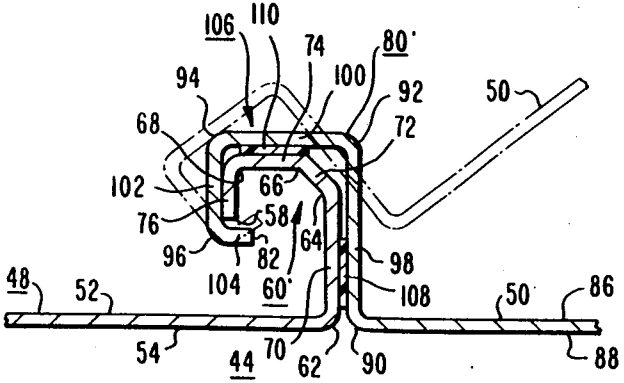
FIG. 3 is an enlarged cross sectional view of one of the interlocking canopy joints shown in FIG. 2, with the hooking and pivoting action which joins two adjacent canopy panel members being shown in phantom.

The first bend configuration 60, as shown most clearly in the enlarged cross sectional view of bend configuration 60' in FIG. 3, includes a first right angle bend 62 which is parallel to and spaced from the second lateral edge 58 of panel member 48. The first right angle bend 62 bends the sheet material perpendicularly outward from the upper major surface 52. The first right angle bend 62 is followed by consecutive bends 64,66, and 68, with "consecutive" referring to the position of the bends from bend 62 to the edge 58 of the panel member 48. Bends 64 and 66 are first and second obtuse bends, which bend the sheet metal inwardly, back towards the body of the panel member 48, and bend 68 is a second right angle bend, which directs the sheet metal in a plane which is perpendicular to the plane of the major surfaces 52 and 54. Bends 62, 64, 66 and 68 are spaced to define straight sections between them, i.e., straight section 70 between bends 62 and 64, straight section 72 between bends 64 and 66, straight section 74 between bends 66 and 68, and straight section 76 between bend 68 and the second lateral edge 58 of panel member 48. Obtuse bends 64 and 66 are preferably each equal to 135 degrees, but other angles may be used to provide a transition section 72 which extends between the vertically oriented straight section 70 and the horizontally oriented straight section 74.

Panel members 46 and 50 each have their lateral edge which joins the intermediate panel member 48 bent into bend configurations 80 and 80', respectively, which bend configurations are complementary to bend configurations 60 and 60', respectively. Bend configurations 80 and 80' are mirror images of one another, and they will be collectively referred to as the second bend configuration 80.

The second bend configuration 80 is shown most clearly with reference to bend configuration 80' associated with panel member 50 in FIG. 3. Panel member 50 includes first and second lateral edges 82 and 84, respectively, and upper and lower major flat surfaces 86 and 88, respectively. Bend configuration 80' includes a first right angle bend 90 which is parallel to and spaced from the first lateral edge 82. The first right angle bend 90 bends the sheet metal of panel member 50 perpendicularly outward from major flat surface 86. The first right angle bend is followed by consecutive right angle bends 92, 94 and 96, forming straight sections 98, 100, 102 and 104. The second right angle bend 92, instead of being directed inwardly as in the first bend configuraiton, is directed outwardly and away from the associated panel member. The spacings between the bends of the second bend configuration 80 are selected according to the dimensions and configuration of the first bend configuration 60, to cause the second bend configuration 80 to snugly surround the first bend configuration, as will be hereinafter explained.

In the assembly of canopy 44 according to the teachings of the invention, the panel member 48 of canopy 44 which lies directly below the cross-head beam 20 is placed into position on the upper edges of the upstanding wall portions of the cab 12. The extreme ends of panel member 48 will thus rest upon the flanges 34 and 36 of the side walls 26 and 28, respectively, and panel member 48 is secured in this position via suitable hardware fasteners, such as screws 42. Panel member 50 is then placed in the position shown in phantom in FIG. 3, such that the lip defined by straight section 104 is hooked under the lateral edge 58 of the intermediate panel member 48. Panel member 50 is then pivoted into the position shown in solid in FIG. 3, to form an interlocking joint 106. In the interlockng position of the complementary first and second bend configurations 60 and 80, respectively, lip 104 is directly below lateral edge 58, preventing upward movement of the second bend configuration 80 relative to the first bend configuration 60, straight portions 76 and 102 are in contact with one another, straight sections 74 and 100 are in contact with one another, and straight sections 70 and 98 are in contact with one another. In a preferred embodiment of the invention, thin strips 108 and 110 of sound deadening material, such as foam tape, may be placed on one of the bend configurations, such as the first bend configuration 60, prior to the formation of joint 106, to insure a tight, squeak-proof joint. After interlocking joint 106 is formed, the sound deadening material 108 is thus located between straight portions 70 and 98, and the sound deadening material 110 is located between straight portions 74 and 100.

After interlocking joint 106 is formed, which joint is devoid of rivets, nuts and bolts, or any other fastener hardware, the edges of panel member 50 which rest upon flanges 32, 34, and 36 of the upstanding wall portions 24, 26 and 28, respectively, and joined thereto with suitable fastener hardware. It should be noted that interlocking joint 106, in addition to enabling panel members 48 and 50 to be quickly and reliably joined at the job site, also functions to stifffen the canopy 44.

Panel member 46 is then joined to the intermediate panel member 48 in exactly the same manner as just described relative to panel member 50, forming an interlocking joint 112 between panel members 46 and 48. Interlocking joint 112 adds still additional mechanical stiffening to canopy 44.

In summary, there has been disclosed a new and improved elevator cab, and method of assembling same, which permits the cab canopy to be quickly and easily assembled to the upstanding wall portions in the field. The canopy is installed in easily handled sections, without seam hardware, via strong, mechanically stiffening interlocking joints. The pivotally formed joints are easily formed within the confine of the elevator hatch, without interference with the cross-head beam of the sling. While not shown in the drawings, the forward panel member 50 may be provided, for example, with provisions for mounting the door operator and emergency light and the rear panel member, for example may be provided with emergency exit, fan and vent holes.

We claim as our invention:

1. An elevator cab, comprising:

a sling having first and second upstanding stiles and lower and upper cross beams which extend between said first and second upstanding stiles, a platform supported by said sling, upstanding wall portions on said platform having upper edges for supporting a canopy, said upstanding wall portions including first and second side walls disposed immediately adjacent to said first and second upstanding stiles, respectively, and front and rear walls, a canopy having lower and upper surfaces, and outer edges, and means securing the outer edges of said canopy to the upper edges of said upstanding wall portions, said canopy being constructed of at least first and second metallic panel members, said first and second panel members having adjacent edges, said adjacent edges being bent to form first and second complementary bend configurations, respectively, which interconnect the first and second panel members via an interlocking joint which is devoid of additional fastener means, and which is formed by pivoting the second bend configuration about the first bend configuration, said first and second complementary bend configurations each including a plurality of bends, with each bend configuration including a first right angle bend which extends perpendicularly outward from the upper surface of said canopy, the adjacent edges of said first and second panel members being oriented such that the interlocking joint between them extends between the first and second side walls, to enable the interlocking joint to be pivotally formed without interference with the upper cross beam of said sling.

2. The elevator cab of claim 1 wherein the first right angle bend of the first bend configuration is followed consecutively to the edge of the panel member by first and second obtuse bends and a second right angle bend, to define first, second, third and fourth straight sections, and the first right angle bend of the second bend configuration is followed consecutively to the edge of the panel by second, third and fourth right angle bends, to define first, second, third and fourth straight sections.

3. The elevator cab of claim 2 wherein the fourth straight section of the first bend configuration is oriented perpendicular to the fourth straight section of the second bend configuration, to prevent upward movement of the panel member having the second bend configuration, after the interlocking joint has been formed.

4. The elevator cab of claim 2 including sound deadening means disposed between the first straight sections of the first and second bend configurations, and between the third and second straight sections of the first and second bend configurations, respectively.

5. The elevator cab of claim 2 wherein the second straight section of the first bend configuration extends between the first and second straight sections of the second bend configuration.

6. The elevator cab of claim 1 wherein the canopy is constructed of first, second and third adjoining metallic panel members, with said second panel member extending between the first and second side walls, immediately below the top beam, said second panel member being connected to said first and third panel members via interlocking joints which extend between the first and second side walls, with the edges of said second panel member which adjoin the first and third panel members each being bent into the first bend configuration, and with the edges of the first and third panel members which adjoin the second panel member being bent into the second bend configuration.

7. The elevator cab of claim 2 wherein the bends of the first bend configuration direct the first bend configuration inwardly, over the associated panel member, and the bends of the second bend configuration direct the second bend configuration outwardly away from the associated panel member.

8. A method of constructing an elevator cab on a platform having a sling which includes a top beam having a longitudinal axis, comprising the steps of:

assembling upstanding wall members on the platform to define upper edges adapted to receive a canopy, and constructing a canopy on said upper edges by the steps of:

providing first, second and third metallic panel members, each having first and second lateral edges, bending the first and second lateral edges of said second panel member to form first bend configurations which extend inwardly towards the body of said second panel member, and which are mirror images of one another, bending a predetermined lateral edge of each of said first and third panel members to form second bend configurations which extend outwardly from their associated panel members, and which are complementary to the first bend configurations on the first and second lateral edges, respectively, of said second panel member, positioning said second panel member below the top beam of the sling, with said positioning step including the step of orienting the bent first and second lateral edges of said second panel member such that they are parallel with the longitudinal axis of the top beam, fastening said second panel member to upper edges of said upstanding wall members, forming interlocking joints between the second panel member and each of the first and third panel members by pivoting the second bend configuration of the first panel member about the first bend configuration formed by the first lateral edge of the second panel member, and by pivoting the second bend configuration of the third panel member about the remaining first bend configuration of the second panel member, and fastening said first and third panel members to upper edges of said upstanding wall members.

* * * * *